United States Patent [19]

Laybourne

[11] 4,127,338

[45] Nov. 28, 1978

[54] WRITING INSTRUMENT

[76] Inventor: Sidney C. Laybourne, Rte. 5, Box 166-A, Martinsburg, W. Va. 25401

[21] Appl. No.: 736,158

[22] Filed: Oct. 27, 1976

[51] Int. Cl.[2] ..... A46B 5/02

[52] U.S. Cl. ..... 401/8

[58] Field of Search ..... 401/8, 6

[56] References Cited

U.S. PATENT DOCUMENTS

| | | | |
|---|---|---|---|
| D. 212,981 | 12/1968 | Laybourne | 401/8 X |
| 3,505,700 | 4/1970 | Rodriguez | 401/8 X |
| 3,623,820 | 11/1971 | Prather | 401/8 |

*Primary Examiner*—Stephen C. Pellegrino

[57] ABSTRACT

Disclosed is a holder for a writing instrument, the holder comprising a forward cylindrical gripping section and a rearward support section. The support section tapers outwardly and curves upwardly and is of such length that it nests comfortably against and is supported by the inner surface of the index finger of the user while not interfering with normal finger contact on the gripping section. During use, support of the instrument is effected primarily by this nesting between the support section and the index finger, whereby finger pressure on the gripping section may be reduced quite significantly, such pressure being required only for control or guidance of the writing point. The support section may also include wing segments forming a radially resilient band encircling the index finger of the user, the band not only lending further support for the instrument while in writing use but providing means for quickly and conveniently storing the instrument on the user's finger when not in use.

1 Claim, 9 Drawing Figures

FIG. 6
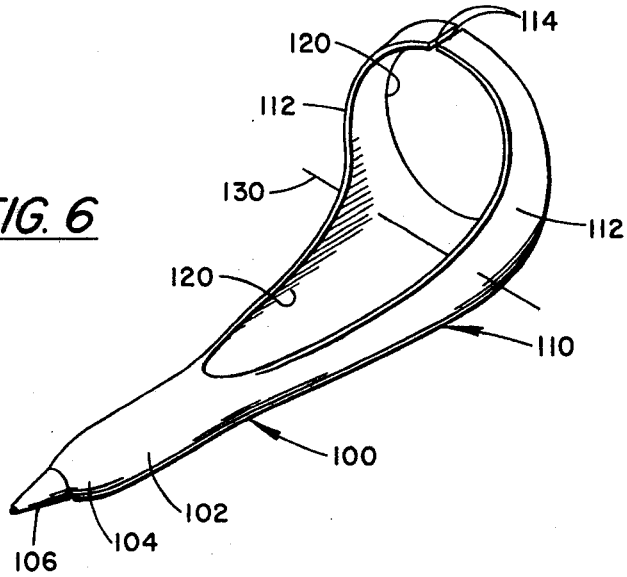
FIG. 7
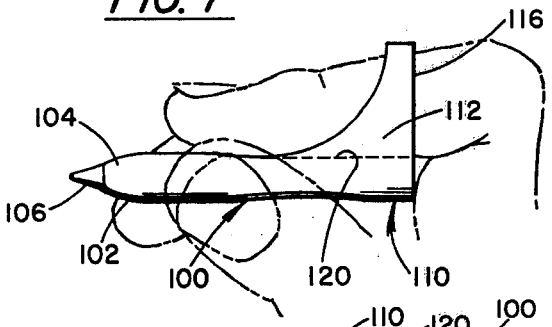
FIG. 9
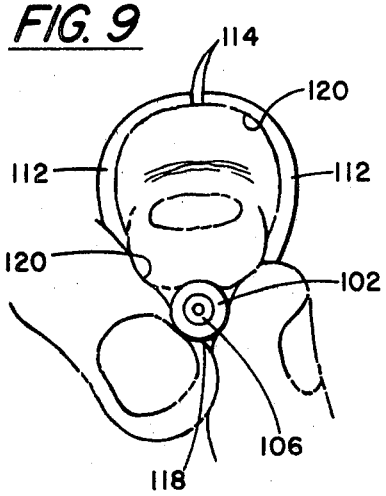
FIG. 8
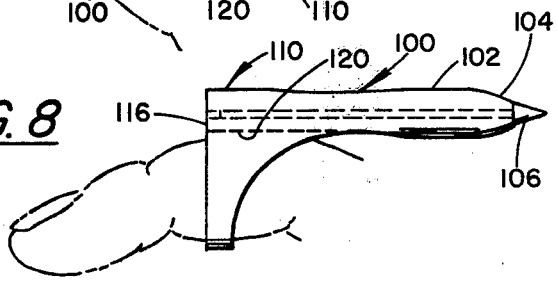
FIG. 1
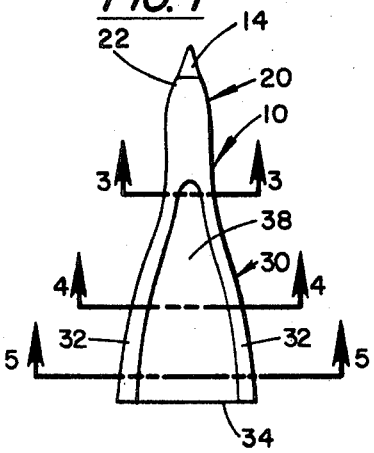
FIG. 2
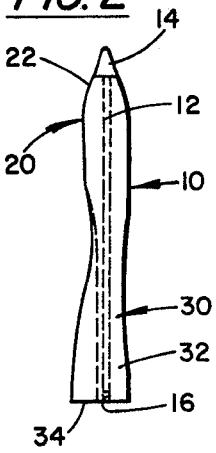
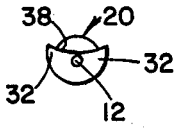
FIG. 3
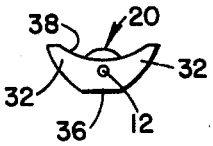
FIG. 4
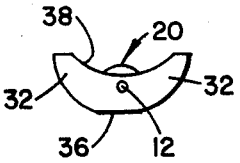
FIG. 5

WRITING INSTRUMENT

BACKGROUND OF THE INVENTION

Over the years, literally hundreds of proposals have been advanced in an effort to alleviate if not eliminate two basic problems traditionally encountered in the writing instrument field.

Particularly if used for long periods of time, the usual writing instrument will become quite tiring to the hand because of the constant and fairly substantial pressure necessary to prevent slipping and sliding of the fingers along the straight, generally cylindrical surface of the instrument holder. And even further compounding the problem is the fact that many times the fingers will become uncomfortable if not actually painful where in contact with the instrument, because of the degree of pressure necessary to avoid such finger slippage.

Although the art is replete with instrument structures which have been suggested as solutions for this two pronged problem involving fatigue and comfort, none of the prior proposals have met with any significant commercial success. Most have been directed to specialized shapes or constructions which, even if theoretically alleviating the problem, fail to recognize one very basic and essential factor. Hardly any two individuals hold a writing instrument in exactly the same manner, and most will resist either purchasing or using an item which might require a change in their customary "grip".

Thus, while recognized as being a less than ideal compromise, the writing instrument industry has found it impractical to deviate to any significant extent from a generally cylindrical gripping surface or section for a writing instrument. In this context, of course, it will be appreciated that throughout this application the term cylindrical is used broadly to include not only a circular cross section but the usual hexagonal and similar symmetrical cross sections as employed commonly for writing instrument holders.

Another long standing problem in the writing instrument field relates to safe, convenient and efficient storage of an instrument between uses. For many years, desk sets have been available for use by those who customarily work at an office desk, and in many cases such sets have proven relatively satisfactory—providing convenient storage for a pen or pencil between uses. Even where one works at a desk or table, however, temporary misplacement of a writing instrument can become a problem. For example, an accountant, Patent Office Examiner, engineer, or the like, may have to make numerous entries or notes after manipulating various books, files, papers, drawings, catalogs, etc., spread over his desk or table. In most such situations the pen or pencil is simply placed on the desk or table while the books or papers are being handled. When the time comes to make a note or entry, the pen or pencil may well be hidden under a paper or drawing, necessitating a time consuming and disrupting shuffling of items in order to locate the instrument.

Students, meter readers, parking meter attendants, stockroom clerks, waitresses and sales clerks are examples of other groups of individuals who frequently encounter problems in carrying and using a writing instrument. Even if the clothing being worn is provided with pockets, the pockets may be inaccessible under a raincoat or heavy winter jacket, the instrument being used may not have a pocket clip and/or cap to prevent soiling, or it may be too time consuming to remove and replace the cap and/or clip the instrument in a pocket each time writing is required. The disposition or storage of a writing instrument represents a real problem for such individuals, particularly if they must manipulate and handle other objects between uses of the instrument.

Numerous attempts have been made in an effort to solve this problem of temporary writing instrument storage. Many have involved what might be called "thimble" or "finger" type pens, of which the following patents are representative:

U.S. Pat. No. 198,484
U.S. Pat. No. 361,535
U.S. Pat. No. 488,945
U.S. Pat. No. 504,918
U.S. Pat. No. 684,685
U.S. Pat. No. 2,509,837
U.S. Pat. No. 3,402,984
U.S. Pat. No. 3,887,286
U.S. Pat. No. 3,947,132
Swiss Pat. No. 458,121
Australian Pat. No. 158,264
French Pat. No. 1,214,577

As far as is known, however, none of these proposed prior constructions have met with any significant, long term commercial acceptance in spite of the need for a conveniently carried and stored writing instrument.

The "thimble" type pen (i.e. U.S. Pat. No. 684,685) is merely placed on the outer end of a finger, with the point forming a projection of the finger. Such an instrument not only is quite difficult and awkward to manipulate with any degree of precision and impossible to grip in a normal manner, but fails to solve the problem of storage between uses should the writer find it necessary to manipulate other objects.

A "finger" type pen such as that shown in U.S. Pat. No. 361,535 or Australian Pat. No. 158,264 represents a somewhat more desirable and practicable approach, in that the writing point is offset below the finger which permits somewhat better support by adjacent fingers and better writing control. Here again, however, none of these proposed devices provide for a clear and unobstructed gripping area for the three fingers normally employed in writing. Thus, none would meet the need for avoiding any interference with individual differences and preferences in gripping a writing instrument during use. Further, these "finger" pens would not be susceptible of convenient storage in an inoperative position on the finger of the user.

Accordingly, it is a principal object of this invention to provide an improved writing instrument which may be used for long periods without fatigue or discomfort.

Another object of this invention is the provision of an improved writing instrument which is constructed to nest against the inner surface of the user's index finger while simultaneously being gripped in a normal writing manner.

A further object of this invention is to provide an improved writing instrument having a forward gripping section adapted to be gripped in a normal manner and a rearward support section having a band encircling the index finger of the user and positioning the support section in a nested relationship against the inner surface of that finger.

An additional object of this invention is the provision of an improved writing instrument which may be placed on the index finger in one position for writing use and in another position for storage.

Yet another object of this invention is the provision of an improved writing instrument having a band adapted for holding the instrument on a finger either in a writing or storage position, the band being radially resilient to accommodate fingers of various size.

A still further object of this invention is to provide an improved writing instrument having a finger encircling band of such resiliency and configuration that the finger may be rotated, skewed or otherwise adjusted as might be necessary to permit any preferred normal grip.

Yet another object of this invention is the provision of a finger carried writing instrument in which the writing unit may be rapidly and easily replaced.

A still further object of this invention is to provide an improved writing instrument which is easily and economically manufactured, which is durable and requires minimal maintenance and which may be easily and quickly mounted on or removed from a finger either in a writing or storage position.

Still other features and advantages of the writing instrument of the present invention will be more fully described hereinafter or will be apparent from the following description and/or the appended drawings.

SUMMARY OF THE INVENTION

Briefly, the writing instrument of the present invention is comprised of a holder and a writing unit housed within the holder and provided with a writing point extending beyond one end thereof. The holder is characterized by a forward portion defining a gripping section which is generally cylindrical and which terminates at one end in a reduced nose portion through which the point of the writing unit extends. The holder is further characterized by a rearward portion defining a support section which from the periphery of the gripping section flares outwardly along generally diametrically opposed sides of the holder, which terminates in an end surface disposed generally transversely of the holder, and which defines a curved surface forming a depression intersecting the end surface of the support section and extending forwardly thereof axially along a third side of the holder toward the gripping section. The holder is about 1½ inches to about 2½ in overall length, with the rearward portion thereof comprising at least about 50 percent of this overall length.

When the instrument is in writing use, the curved surface of the support section nests comfortably against and is supported by the inner surface of the index finger of the user, with the fingers of the user being free to grasp the gripping section in whatever position the user may prefer.

Should it be desired to adapt the instrument for storage on the user's finger between uses, a resilient band may be provided by and as part of the support section, the band being radially resilient and of such configuration that the flexure thereof is relatively uniform to accommodate fingers of various sizes. Should it be desired to switch the instrument between use and storage positions, the band is lightly gripped on generally diametrically opposed points by the fingers adjacent to the index finger, the index finger withdrawn rearwardly from the band, the index finger used to flip the instrument end for end, and the index finger then re-inserted in the band with the holder above the finger and pointing rearwardly thereof.

BRIEF DESCRIPTION OF THE DRAWINGS

FIG. 1 is a top elevational view of a writing instrument constructed in accordance with the present invention.

FIG. 2 is a side elevational view of the writing instrument of FIG. 1.

FIGS. 3, 4 and 5 are cross sectional views of the writing instrument of FIG. 1, as taken on the lines 3—3, 4—4 and 5—5 thereof.

FIG. 6 is a front perspective view of another embodiment of a writing instrument constructed in accordance with the present invention.

FIG. 7 is a side elevational view of the writing instrument of FIG. 6, shown mounted on the finger of and otherwise gripped by the user in writing position.

FIG. 8 is a side elevational view of the writing instrument of FIG. 6, shown mounted on the finger of the user in storage position.

FIG. 9 is a front elevational view of the writing instrument of FIG. 6, shown mounted on the finger of and otherwise gripped by the user in writing position.

DESCRIPTION OF THE PREFERRED EMBODIMENT

Referring first to FIGS. 1 through 5, a writing instrument constructed in accordance with the present invention can be seen as being comprised of a holder 10 and a writing unit 12 having a point 14 extending beyond one end of the holder. Although it will be understood that other types of writing units and/or points may be utilized, in the illustrated embodiment the unit 12 comprises a ballpoint refill having an elongate reservoir tube frictionally mounted in an appropriately sized bore 16. The bore 16 extends the complete length of and opens through the ends of holder 10, whereby the tip 14 extends beyond one end of the bore, with the other end serving as an atmospheric vent for the ballpoint reservoir.

The holder 10 preferably is injection molded in a suitable die and formed of a synthetic resin having good strength and dimensional stability and capable of taking an attractive and long wearing surface. Any one of a number of synthetic resins will be suitable for use in this embodiment, but an olefin such as polyethylene or polyproplene is suggested.

As will be noted from the drawing, the holder 10 is formed to include a forward portion comprising a generally cylindrical gripping section 20 which terminates at its outer or forward end in an inwardly tapering nose portion 22 through which the point 14 projects.

The rearward portion of the holder 10 comprises a support section 30 axially aligned with and blending smoothly into the inner or rearward end of the gripping section 20. As will be apparent particularly from FIG. 1, this support section flares outwardly from the periphery of the gripping section 20 along diametrically opposed sides of the holder 10 to form a tapered wing 32 along each such side. Rearwardly, this flared support section 30 terminates in an end surface 34 which is disposed generally transversely of the longitudinal axis of the holder 10.

As will be seen best from FIGS. 3, 4 and 5, wings 32 curve upwardly in cross section from a generally flat bottom surface 36. This flat surface 36 extends axially along the support section 30 to approximately the rearward end of the gripping surface and provides a stable "anti-roll" base on which to rest the instrument when it is not being carried or used.

Diametrically opposed to the bottom surface 36 is a curved surface 38 defining a concave depression which intersects the end surface 34 and extends forwardly thereof axially along the support section 30 to adjacent the inner or rearward end of the gripping section 20. This surface or depression 38 preferably is formed to a depth which is slightly below the cylindrical surface of the gripping section 20 and at its forward end smoothly blends upwardly into the gripping section surface.

The concave depression or surface 38 constitutes a longitudinal segment of a cylindrical surface of revolution, the axis of which is disposed in a spaced, generally parallel relationship with the longitudinal axis of the holder 10. For reasons which will be apparent from the following description, the diameter of this circle of revolution may range between about ½ inch and about 1 inch.

In using the instrument 10, the rearward support section 30 is nested against the inner surface of the writer's index finger, with the longitudinal axis of the holder 10 being generally aligned with the axis of the finger. The holder should be oriented so that the convex curvature of the index finger confortably rests in the concave depression 38, with the end surface 34 against the angularly offset finger surface as provided when the second joint of the finger is bent. When the support section 30 is thus nested under and supported against the inner surface of the user's index finger, the gripping section 20 is completely free and clear of any obstruction and may be gripped in any manner normally used by the writer in holding a conventional pen or pencil. In this connection, it should be noted and understood that the depression 38 will not in any way restrict the writer from rotating or skewing his finger relative to the support section 30 in whatever manner he may desire to secure his normal finger grip on the gripping section 20.

As will be obvious to those skilled in the art, the overall length of the holder 10 is important to insure that when the support section 30 is properly nested against the index finger, the gripping section 20 and point 14 protrude sufficiently for convenient gripping and easy manipulation. Since the hand size of writers will vary quite significantly as between children and adults and men and women, it may be desirable to provide the holder 10 in a choice of lengths. For most users, however, it has been found that an overall holder length of about 1¾ inches to about 2½ inches will serve quite adequately. Of this overall length, the gripping section 20 should comprise between about 25 to about 50 percent, preferably about 30 to 40 percent.

While the instrument of the present invention is particularly adapted to be held or gripped in whatever manner the user normally employs with a conventional pen or pencil, it will be understood that the pressure involved in this grip may be very light — just sufficient to accommodate the control desired by the writer for manipulating the point 14. A major portion of the support for the holder is provided by the nesting engagement between the support section 30 and the user's index finger. Thus, the instrument of the present invention may be used for long periods without danger either of fatigue in the hand or of uncomfortable or painful contact with the gripping section.

Prior to proceeding further with this description, it should be emphasized that a great majority of writers normally grip a writing instrument with the first three fingers or digits (thumb, index or forefinger and middle finger) of the hand used for writing. An instrument constructed pursuant to the present invention will be held with the same three fingers. In a few instances, however, where a writer may have lost his index or some other finger or fingers or for some other reason has adopted an unusual style of grip, he may use one or more other fingers for writing. An instrument of the present invention can be accommodated readily in any such other style of grip. It will be understood, therefore, that while the term "index" normally is used in this application with reference to the finger against which the support section 30 rests during writing, this term is to be interpreted broadly as meaning whatever finger the user may employ as the primary support for the holder 10.

Turning now to the embodiment as illustrated in FIGS. 6 through 9, it will be noted that the holder 100 is essentially the same as the holder of the FIGS. 1 - 5 embodiment. The forward portion thereof comprises a generally cylindrical gripping section 102 which curves or tapers inwardly to a reduced nose portion 104. Extending through and beyond the nose portion 104 is the point 106 of a ballpoint or other writing unit (not illustrated).

Extending from the inner or rearward end of the gripping section 102 is a support section 110 having side wing segments 112 which flare outwardly and curve upwardly, essentially the same as the wing segments 32 of the previously described embodiment. As opposed to the wing segments 32 of the previous embodiment, however, the wing segments 112 curve upwardly to a point substantially diametrically opposed to the longitudinal axis of the holder 100, terminating in juxtaposed ends 114.

At its rearward end, the support section 110, including wings 112, terminates in an end surface 116 which is generally planar and disposed transversely of the longitudinal axis of the holder 100. Thus, the end surface 116 forms what might be characterized as an integral "stand" for maintaining the instrument in a perpendicular point-up position should it be placed in that position on a horizontal surface between uses. In addition, the lower side of the support section 110 may be provided with a flat bottom surface 118 (FIG. 9) to prevent rolling of the instrument should it be placed horizontally on a desk or table while not in use.

It will be noted particularly from FIGS. 7 and 8 that in side profile the wings 112 are relatively wide at their roots, and become progressively narrower as they curve upwardly. Also, it will be noted from FIG. 9 that the wings generally become thinner as the distance from the holder 100 increases. As will be understood, this generally uniform decrease in cross sectional mass or configuration will result in a correspondingly uniform increase in resiliency, the purpose of which will be described in greater detail hereinafter.

Intersecting end surface 116 and extending forwardly thereof axially along support section 110 to adjacent the gripping section 102, is a concave depression or curved surface 120. As with the previously described embodiment, this depression is adapted to nest against the inner surface of the user's index finger while writing, as illustrated best in FIG. 7.

The depression 120 constitutes a longitudinal section of a cylindrical surface of revolution, the axis of which is disposed in a spaced, generally parallel relationship with the axis of the holder 100. The inner surfaces of the wings 112 fall on and form a continuation of this surface of revolution which has a diameter ranging between about ½ inch and about 1 inch.

As will be understood, the inside diameter of the finger encircling band formed cooperatively by wings 112, may be varied at time of manufacture of the instrument to accommodate major differences in finger size as between different users. Relatively minor differences, however, are readily accommodated by the resiliency of the wings 112. In this connection, it will be recalled that wings 112 preferably are designed to provide generally uniform flexure under stress, as would be generated by placement of the instrument on a finger having a diameter somewhat greater than that of the curved surface 120. As a result of this uniform stress feature, not only will ends 114 separate under outwardly directed internal pressure, but wings 112 will expand generally radially as opposed to simply being bent outwardly. Thus, fit of the instrument will be comfortable without the feeling of tight spots on the finger.

Turning now to use and storage of the instrument of this embodiment, attention is called particularly to FIGS. 7, 8 and 9. FIG. 7 shows the instrument mounted on a user's index finger in writing position. It will be seen that the support section 110 is nested comfortably under and against the inner surface of the index finger, with the end surface 116 supported by the surface immediately behind the second joint of the finger. Forwardly of the support section 110, the fingers of the user are free to assume any desired grip on the gripping section 102, the usual three finger grip being illustrated in FIGS. 7 and 9. Particularly from FIG. 9, it will be noted that the gripping section 102 is completely clear of any obstruction to whatever grip the user might employ.

When the instrument is in the writing position, of course, the band (wings 112) encircling the finger will help insure against any inadvertent movement or shifting as between the finger and instrument.

It is an important feature of the present embodiment that the instrument may be conveniently and easily carried in a stored position on the user's finger when not in use. The stored position is illustrated in FIG. 8. This position may be accomplished quickly and conveniently simply by placing the thumb and middle finger against the wings 112 as generally indicated by the axis line 130 in FIG. 6, withdrawing the index finger from the support section 110 and rotating the instrument therewith end for end around the axis 130, and reinserting the index finger through the band as indicated in FIG. 8. When in this position, the finger is quite free and can be used to grasp and/or manipulate other objects. One point to be noted particularly is that when the instrument is in the stored position, all joints or knuckles of the finger are free to bend without obstruction.

As will be readily understood, the instrument of the present invention may be used with various types of writing units, such as pencils, fountain pens, fiber tip markers, and the like. The construction of the holder likewise may vary in configuration as, for example, use of gripping section with a hexagonal cross section rather than one of cylindrical shape. The internal diameter of the band (wings 112) can be made in various sizes, and the holder length can be varied. Also, various synthetic resins other than olefins may be used in forming the holder. Accordingly, the preceding description and accompanying drawings are given by way of illustration only and are not intended to limit the present invention, the scope of which is to be defined by the following claims.

I claim:

1. A writing instrument comprising an integral one piece holder formed of a resilient synthetic resin and provided with a relatively elongate generally cylindrical gripping section terminating forwardly in a reduced nose portion and a support section terminating rearwardly in a generally planar end surface positioned transversely of said holder, said holder including an elongate axially disposed bore opening at opposite ends through said nose portion and said planar end surface, a writing unit removably mounted within said bore and provided forwardly with a point projecting through and beyond said nose portion and rearwardly with a vent communicating with the atmosphere through said aperatured planar end surface, a pair of wing segments tapering rearwardly from adjacent said gripping section and flaring outwardly from diametrically opposed sides of said support section, a concave surface formed in said support section by a surface of revolution intersecting said planar end surface and extending forwardly thereof axially along a third side of said support section, said wing segments curving upwardly relative to said third side around said surface of revolution and defining a generally circular band dimensioned to receive the finger of a user, the rearward surface of said band comprising a generally flat surface aligned with said planar end surface and forming therewith a first stand adapted to hold said instrument in a vertical position relative to a support surface, a substantially flat lower surface intersecting said planar end surface and extending forwardly thereof axially along a forth side of said support section, said flat lower surface forming a second stand adapted to hold said instrument in a horizontal position relative to said support surface, said wing segments being substantially equal in length and configuration and terminating in contiguous ends at a point substantially diametrically opposed to the longitudinal axis of said holder, said wing segments progressively decreasing in both thickness and width and increasing in resiliency with the distance from said support section to permit uniform flexure of said wing segments and radial expansion of said band in response to the application of outward pressure exerted internally thereof, said radially expansive band and said rearwardly tapering wing segments cooperatively providing both for angular skewing of the user's finger relative to the longitudinal axis of said holder in positioning said instrument for use, and for limited transverse movement between the user's finger and said holder during use.

* * * * *